United States Patent [19]

Elderfield

[11] 4,021,157

[45] May 3, 1977

[54] DIAPHRAGM PUMPS DRIVEN BY PULSE PISTONS

[75] Inventor: David Henry Theophilus Elderfield, Fordingbridge, England

[73] Assignee: Sedco Products Ltd., Salisbury, England

[22] Filed: Apr. 8, 1975

[21] Appl. No.: 566,517

[30] Foreign Application Priority Data

Apr. 11, 1974 United Kingdom ..... 16379/74

[52] U.S. Cl. ..... 417/387; 417/383; 417/395; 92/98 R

[51] Int. Cl.[2] ..... F04B 9/10; F04B 35/02

[58] Field of Search ..... 417/383, 385, 388, 389, 417/394, 395, 387; 92/98 R, 171

[56] References Cited

UNITED STATES PATENTS

| | | | |
|---|---|---|---|
| 1,528,097 | 3/1925 | Cooper | 92/171 |
| 2,129,828 | 9/1938 | Dunn | 417/222 |
| 2,304,992 | 12/1942 | Foster | 92/171 |
| 2,339,876 | 1/1944 | Phillips | 92/98 R X |
| 2,612,837 | 10/1952 | Midgette | 417/273 |
| 2,740,259 | 4/1956 | Westlund | 417/395 |
| 2,871,789 | 2/1959 | Kiffer et al. | 417/383 X |
| 2,948,223 | 8/1960 | Mashinter | 417/388 X |
| 3,218,978 | 11/1965 | Kalert | 417/395 |
| 3,351,088 | 11/1967 | Jensen | 92/98 R X |
| 3,496,874 | 2/1970 | Findley | 417/383 |
| 3,640,647 | 2/1972 | Hart | 417/389 |
| 3,680,981 | 8/1972 | Wagner | 417/388 |

*Primary Examiner*—Carlton R. Croyle
*Assistant Examiner*—Thomas I. Ross
*Attorney, Agent, or Firm*—Wenderoth, Lind & Ponack

[57] ABSTRACT

A diaphragm pump having a pump chamber divided into two portions by a diaphragm of elastomeric material which is generally of hemispherical shape and clamped at its periphery in the pump chamber. The portion of the chamber including the interior of the diaphragm communicates with a cylinder in which a piston is reciprocated by rotation of a drive shaft. The pump chamber includes inlet and outlet non-return valves for the fluid to be pumped, is detachable as a unit from a housing containing the piston and cylinder and is positioned below a normally horizontal plane containing the axes of the cylinder and drive shaft.

9 Claims, 4 Drawing Figures

DIAPHRAGM PUMPS DRIVEN BY PULSE PISTONS

FIELD OF THE INVENTION

This invention relates to high pressure diaphragm pumps of the kind in which pumping is effected by the dilation of a diaphragm of elastomeric material which is arranged to divide a pump chamber into two portions. One portion of the chamber communicates with a cylinder in which a piston may be reciprocated, the enclosed space being completely filled with an hydraulic liquid, such as a suitable oil, so that the piston is reciprocated a corresponding movement of the diaphragm occurs. The other portion of the chamber contains the liquid to be pumped and communicates with inlet and outlet non-return valves.

PRIOR ART

In the known pumps of this kind the elastomeric diaphragm consists either of a cylindrical tubular member which is clamped at each open end or a cylindrical tubular member which is closed at one end and is clamped at the other and open end, see for example, U.S. Pat. No. 3,640,647. Both these arrangements are unsatisfactory in operation in that in order to avoid undue stress on the diaphragm, and hence rapid wear, it is necessary to restrict its movement with the result that the capacity of the pump is reduced

SUMMARY OF THE INVENTION

In the present invention the diaphragm is substantially of hemispherical shape. It is clamped at its periphery in the pump chamber and arranged so that the portion of the chamber which is in communication with the cylinder includes the space within the diaphragm. Such an arrangement is a great improvement over the prior art arrangement in that for a given maximum stress in the diaphragm material a much greater dilation can be obtained with the result that the pump of this invention has a much greater output and the diaphragm does not wear out as quickly.

While a pump according to this invention may comprise a single pump chamber cooperating with a single piston and cylinder, in a preferred arrangement the pump housing has opposite end portions each containing a piston, a cylinder, and a pump chamber mounted on each end portion communicating with the cylinder therein. To increase the delivery of such a pump without increasing the physical size of the components several such units can be coupled together side by side with a common driving shaft.

Preferably the pump chamber has mounted thereon non-return inlet and outlet valves for the liquid to be pumped, and the pump chamber is arranged to be easily detachable as a unit from the main pump housing. This greatly facilitates servicing since if a pump chamber becomes faulty as by breakage of the diaphragm or failure of the valve or valves it can be quickly and easily removed and replaced by a new pump chamber.

It is also preferred that the pump chamber be located below a plane containing the axes of the cylinder and drive shaft, which plane is normally horizontal, since this greatly simplifies bleeding of air from the space enclosed by the cylinder and the connected portion of the pump chamber. Such space must be completely filled with a suitable hydraulic liquid if the pump is to operate correctly.

DESCRIPTION OF PREFERRED EMBODIMENT

Figure 1:
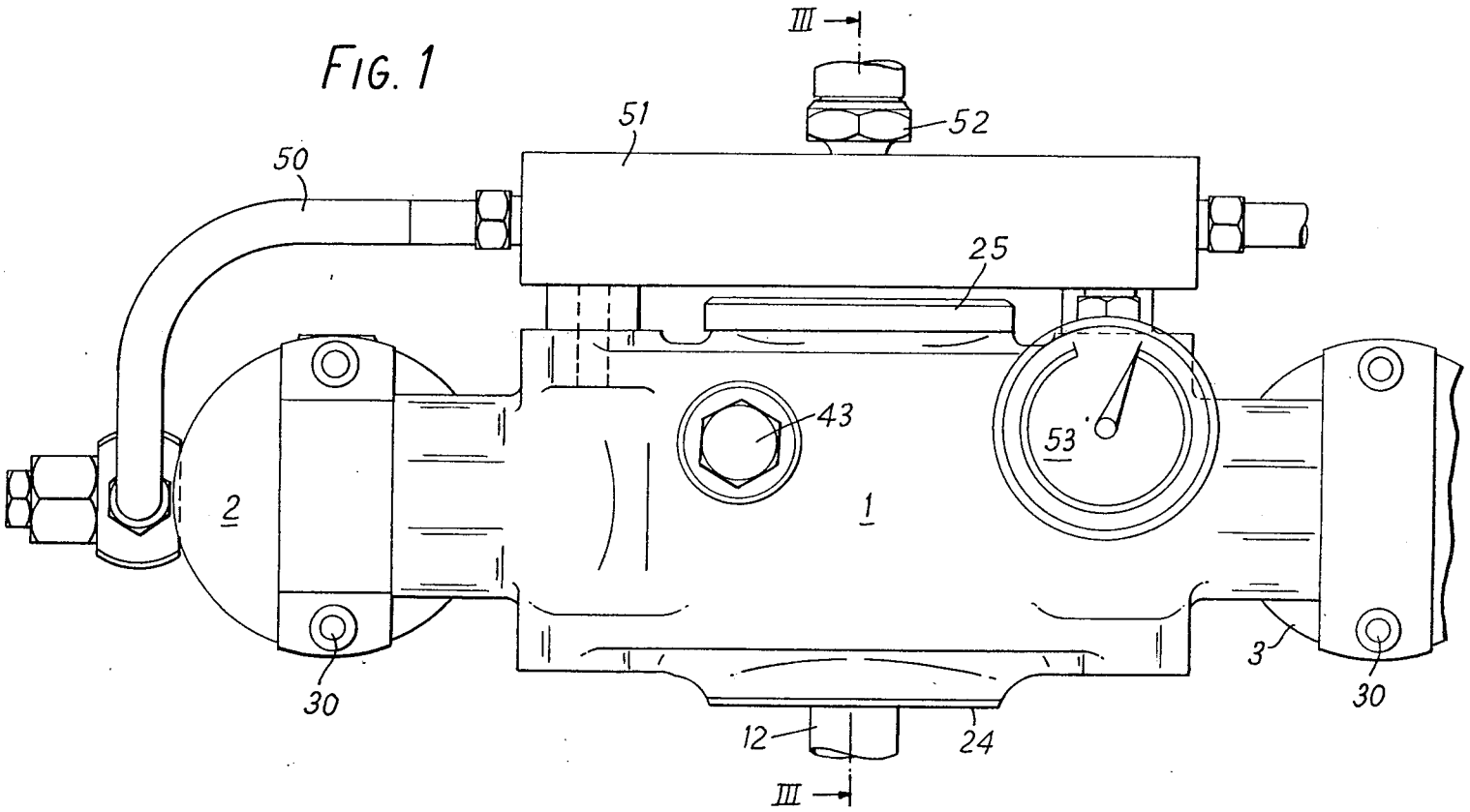
FIG. 1 is a plan view of a pump in accordance with the invention.
Figure 2:
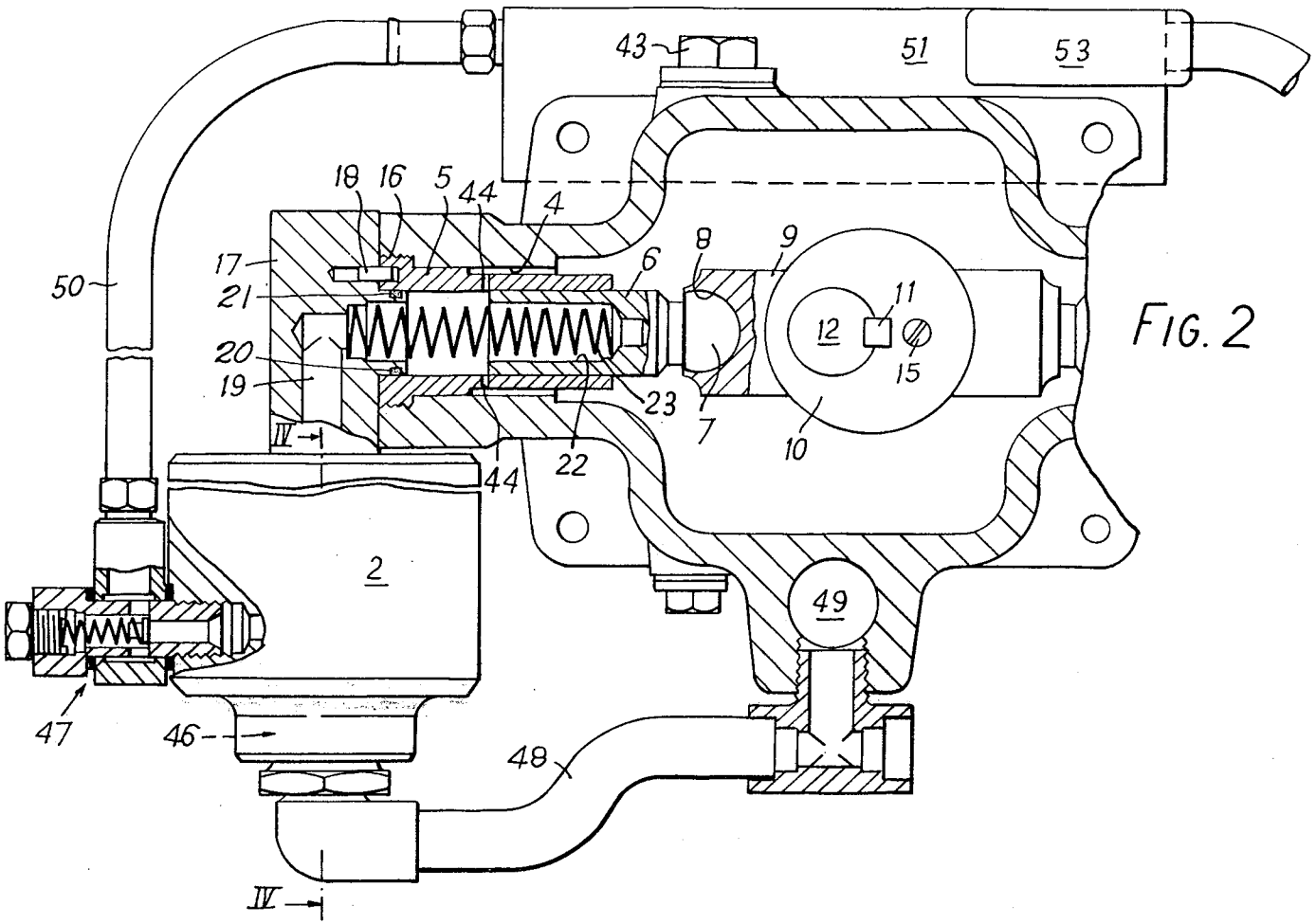
FIG. 2 is a fragmentary side elevation, partly in section of the pump of FIG. 1.
Figure 3:
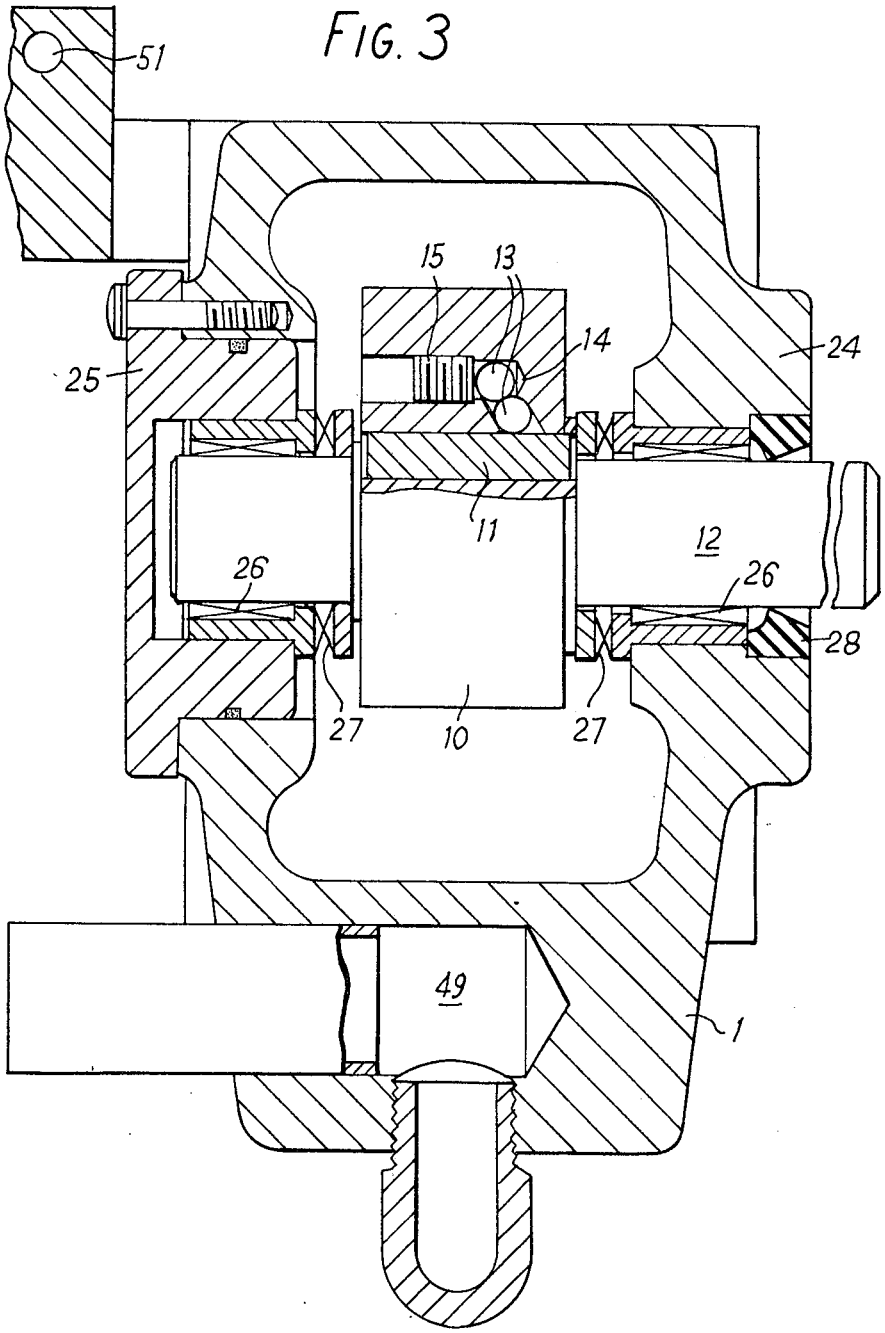
FIG. 3 is a section taken on the line III—III in FIG. 1.
Figure 4:
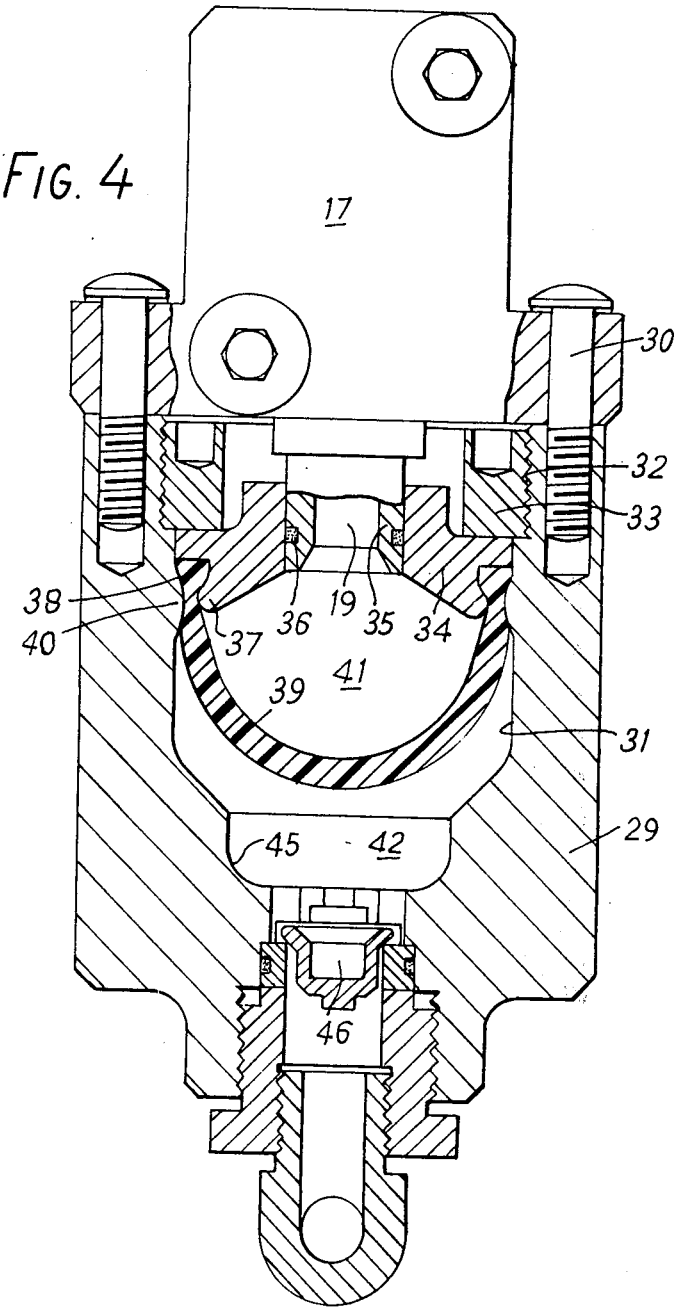
FIG. 4 is a section taken on the line IV—IV in FIG. 2.

The pump shown in the drawings comprises a main housing 1 on each end of which is bolted a pump chamber 2 and 3. At each end the housing has a bore 4 (see FIG. 2) in which is secured a cylinder 5 containing a piston 6. The piston has a ball end 7 seated in a socket 8 in a shoe 9. This shoe bears on an eccentric 10 which is secured by a key 11 on a driving shaft 12. The key 11 is locked in position by a pair of balls 13 which are located in a dog leg hole 14 in the eccentric 10 and are held in position by a grub screw 15. (See FIG. 3).

The cylinder 5 has a flanged head 16 which is threaded and is screwed into an enlarged portion of the bore 4. The pump chamber 2 (3) is secured on the end of the housing 1 by means of a bracket 17 which has a pin 18 which registers with a hole in the cylinder wall to ensure the correct orientation of the cylinder in the bore 4. The bracket 17 is provided with a bore 19 which communicates between the pump chamber 2 and the cylinder 5. The bracket is located by a spigot 20 which enters the cylinder 5 and is sealed therewith by a seal 21.

The piston 6 has a bore 22 containing one end of a compression spring 23, the other end of which is located in the bore in the spigot 20. The compression in the spring ensures that the ball end of the piston 6, the shoe 9, and the eccentric 10 are kept in contact.

The sides 24 and 25 of the housing 1 are provided with journal bearings 26 and thrust bearings 27 for the shaft 12 and seals 28 to prevent the escape of hydraulic liquid from the housing.

The pump chamber 2 comprises a body 29 having an end face secured by bolts 30 to a face of the bracket 17. The body 29 is formed in its end face with a stopped cylindrical bore 31 which has a portion 32 of enlarged diameter at its outer end threaded to receive a threaded locking ring 33. This ring 33 bears on an annular diaphragm clamping member 34 which fits inside the bore 31. The chamber body 29 is located on the bracket 17 by means of a spigot 35 on the bracket 17 which enters the central opening in the annular member 34 and is sealed therewith by a seal 36.

The annular member 34 is formed with an axially extending flange which has a radially outwardly extending nose 37, the flange and nose forming with the wall of the bore 31 a groove in which is received the peripheral edge 38 of an hemispherical diaphragm 39 formed of elastomeric material. The bore 31 is formed with an inwardly extending circumferential rib 40 which with the nose 37 acts to clamp the periphery of the diaphragm 39 in the bore. Assembled the annular member 34, with the diaphragm 39 assembled thereon, is pressed into the bore until the nose 37 lies opposite the rib 40, thus compressing the part of the diaphragm which lies in between. The annular member 34 is locked in this clamping position by the locking ring 33.

The diaphragm 39 divides the pump chamber into an inner portion 41 and an outer portion 42. The inner portion 41, which includes the space within the diaphragm 39, communicates through the bore 19 in the bracket 17 and spigot 35 with the cylinder 5. In operation the whole of the space 41 is filled with a suitable hydraulic oil, so that the diaphragm expands and contracts as the piston 6 moves into and out of the cylinder 5. The oil is introduced into the pump housing 1 through a hole sealed by a plug 43. In order for the oil to flow into the inner portion 41 of the pump chamber and for air to be bled out of this space, the cylinder 5 is provided with ports 44 arranged in its upper and lower wall at a point where they are uncovered by the piston 6 at the end of its outward stroke. The bleeding of air from the inner portion 41 of the pump chamber 2 is greatly facilitated by arranging the pump chambers as shown so that they lie below a plane containing the axes of the cylinders 5 and the drive shaft 12, this plane being substantially horizontal when the pump is in use.

It will be seen that the end wall 45 of the bore 31 is spaced from the diaphragm 39 to allow for expansion of the diaphragm during operation, and also, that the end wall 45 is shaped so as to prevent excessive expansion which might cause the diaphragm to rupture.

The outer portion 42 of the pump chamber communicates with non-return inlet and outlet valves 46 and 47 which are mounted on the body 29 of the pump chamber. The inlet valve 46 is connected by pipe 48 to an inlet manifold 49 formed in the pump housing 1. The outlet valve 47 is connected by a pipe 50 to an outlet manifold 51 mounted on the pump housing 1. This manifold has an outlet union 52 and a pressure gauge 53. The manifold 51 may also be fitted with a burstable diaphragm, not shown, which fractures if the output pressure exceeds a predetermined value and with a pressure relief, or dump valve, not shown, which opens to by-pass the output of the pump if for some reason or other the delivery from the pump is shutoff.

I claim:

1. A diaphragm pump comprising:

a pump housing having two opposing end portions aligned along a common axis;

one hollow cylinder mounted in each end portion aligned along said common axis;

a reciprocal piston mounted in each cylinder;

a drive shaft rotatably mounted within said housing in the horizontal plane containing said cylinders and perpendicular to said common axis between said cylinders;

an eccentric mounted on said drive shaft adjacent to and contacting said pistons in said cylinders, whereby rotating said drive shaft and said eccentric mounted thereon causes said pistons to reciprocally move in said cylinders;

a pump chamber detachably mounted to each of said end portions and in communication with said cylinders, said chambers positioned completely beneath the horizontal plane through said common axis between said opposing ends, and each of said pump chambers being comprised of:

a chamber body with a bore therein, said bore open at only one end of said body;

a circumferential rib around the inside of said bore near the open end thereof; and an annular diaphragm clamping member slidably fitted in and forced against the inside of said bore at the open end thereof adjacent said circumferential rib, said member having an axially extending flange portion and a nose portion opposite said circumferential rib with said diaphragm thereinbetween, whereby a substantially hemispherical diaphragm is securely held within said chamber body between said nose and said rib;

said substantially hemispherical diaphragm being of elastomeric material clamped at its periphery in each of said pump chambers extending downward in said chambers with its curved surface directed toward the bottom of said chamber and dividing said chambers into an inner portion on the inside of said diaphragm in communication with said cylinder and an outer portion on the outside of said diaphragm within said pump chamber; and non-return inlet and outlet valves fitted through each of said pump chambers in said outer portions thereof on the outside of said diaphragms.

2. A diaphragm pump as claimed in claim 1, further comprising a first spigot on each pump chamber sealingly fitted inside each cylinder in each end portion of said pump housing.

3. A diaphragm pump as claimed in claim 1 wherein said open end of said bore has a larger diameter than the rest of said bore, said larger diameter portion being internally threaded, and said diaphragm pump further comprising a threaded annular ring fitted into said threaded open end of said bore above said annular clamping member in the open end of said bore for locking said clamping member into position in said bore.

4. A diaphragm pump as claimed in claim 1 wherein said pistons have partially spherical head portions, and further comprising shoes having partially spherical sockets at one end thereof engaged with said eccentric at the ends opposite said sockets, said spherical sockets engaged with said partially spherical head portions of said pistons.

5. A diaphragm pump as claimed in claim 4 further comprising a biasing spring in said cylinder positioned against said piston for biasing said piston against said eccentric.

6. A diaphragm pump comprising:

a pump housing having at least one open end;

a hollow cylinder within said open end and extending into said housing; a reciprocal piston positioned within said cylinder;

rotatable drive shaft means mounted through said pump housing and in contact with said piston for reciprocally moving said piston in said cylinder;

a bracket having first and second openings thereinto connected by a hollow core therethrough, said bracket connected at said first opening thereinto to said open end of said pump housing with said cylinder contained therein;

a first spigot located at said first opening into said bracket sealingly fitted inside said cylinder in said open end of said pump housing;

a pump chamber located at said second opening into said bracket;

a substantially hemispherical diaphragm clamped at its periphery into said pump chamber with its curved surface directed toward the bottom of said chamber and dividing said chamber into an inside portion corresponding to the inside of said diaphragm and an outer portion corresponding to the area outside said diaphragm within said chamber, said inside portion of said diaphragm communicating with said cylinder through said bore in said bracket connected between said pump chamber and said cylinder in said pump housing; and non-return inlet and outlet valves fitted through said pump chamber into the outer portion of said pump chamber on the outside of said diaphragm.

7. A diaphragm pump as claimed in claim 6, wherein said pump chamber is detachably connected to said second opening into said bracket.

8. A diaphragm pump as claimed in claim 6, wherein said pump chamber is comprised of:

a chamber body with a bore therein open at only one end, said open end adjacent said second open end of said bracket;

a circumferential rib around the inside of said bore near said open end thereof; and an annular diaphragm clamping member slidably fitted in and forced against the inside of said bore in said body at the open end thereof adjacent said circumferential rib, said member having an axial opening therethrough connected to said second open end of said bracket and further having an axially extending flange portion surrounding said axial opening and a nose portion opposite said circumferential rib with said diaphragm between said nose portion and said rib, whereby said diaphragm is securely held within said chamber body between said nose and said rib.

9. A diaphragm pump as claimed in claim 8 further comprising a second spigot located at said second open end of said bracket and sealingly fitted in said axial opening through said annular diaphragm member.

* * * * *